United States Patent [19]

Burchett et al.

[11] 3,982,695

[45] Sept. 28, 1976

[54] STEAM PRODUCING DEVICE

[75] Inventors: Lawrence Burchett, Leawood; Vernon Adams, Shawnee Mission, both of Kans.

[73] Assignee: Brute, Inc., Lenexa, Kans.

[22] Filed: June 23, 1975

[21] Appl. No.: 589,123

[52] U.S. Cl. ..... 239/136; 122/250 R

[51] Int. Cl.[2] ..... B05B 1/24

[58] Field of Search ..... 239/129, 130, 131, 135, 239/136, 137, 138, 128; 122/249, 250 R, 250 S

[56] References Cited

UNITED STATES PATENTS

| | | | |
|---|---|---|---|
| 780,955 | 1/1905 | Newcomb | 122/250 S |
| 1,672,151 | 6/1928 | Clay | 239/136 X |
| 2,104,705 | 1/1938 | Kerrick | 239/129 X |
| 2,355,882 | 8/1944 | Malsbary et al. | 239/137 |
| 2,604,881 | 7/1952 | Masopust | 239/136 X |
| 2,621,635 | 12/1952 | Joosten | 122/250 R |
| 3,522,909 | 8/1970 | Arant | 239/137 X |
| 3,529,771 | 9/1970 | Black | 239/129 |
| 3,811,414 | 5/1974 | Minton | 239/136 X |

*Primary Examiner*—John J. Love

*Attorney, Agent, or Firm*—Fishburn, Gold & Litman

[57] ABSTRACT

A steam producing device is operative to discharge high velocity steam for use in steam cleaning and includes a burner positioned within a housing and supplying heat to a plurality of generally coaxial, fluid containing coils including a warming coil, a closely wound wall cooling or intermediate coil, a preheat coil and a final heat coil. The warming coil is located within the wall cooling coil and discharges thereinto near the upper end of the housing. The wall cooling coil discharges near burner level into the preheat coil which conically decreases in diameter toward the upper end of the housing where it connects to the final heat coil. The final heat coil descends toward the burner and terminates in connection with a nozzle bearing discharge hose. A pump feeds water under substantial pressure to the warming coil to aid in maintaining superheated water through substantially the entire high temperature portion of the system thereby obtaining more efficient heat transfer to the fluid in the coils and decreasing the production of scale and danger of overheated coils. A cleansing solution may be discharged from a second nozzle and mixed with the steam for use in cleaning vehicles and the like.

2 Claims, 4 Drawing Figures

STEAM PRODUCING DEVICE

The present invention relates to cleaning devices and more particularly to improved steam producing devices wherein water is converted to high velocity steam which is directed against soiled surfaces and the like.

Prior art steam cleaning devices are known, however, they have presented serious problems, primarily lack of efficiency in steam production, rapid scale build-up interfering with operation, danger of coil overheating with loss of pressure capacity and/or undue size or complexity.

The principal objects of the present invention are: to provide an improved steam producing device which is substantially more efficient in overall operation; to provide such a device which is operative to generally maintain the fluid in the high temperature coils as superheated water, thereby reducing the tendency for scale build-up therein; to provide such a device having a unique coil arrangement for low heat loss and inhibition of condensation on input coils; to provide such steam cleaning equipment which is not as subject to the dangers of overheated coils as prior art structures; to provide such an arrangement which is of relatively small size for its capacity and yet does not present an exterior surface which is too hot for contact by operating personnel; to provide such a steam producing device having a nozzle operative to effectively convert superheated water to high velocity steam; to provide such a device which is adapted to add cleansing material or a cleaning agent at the steam nozzle whereby a cleaning liquid may be utilized without prior vaporization; and to provide such a steam producing device which is economical to manufacture, simple and durable in construction, safe in use, and particularly well adapted for its intended purpose.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the steam producing device.

Figure 1:
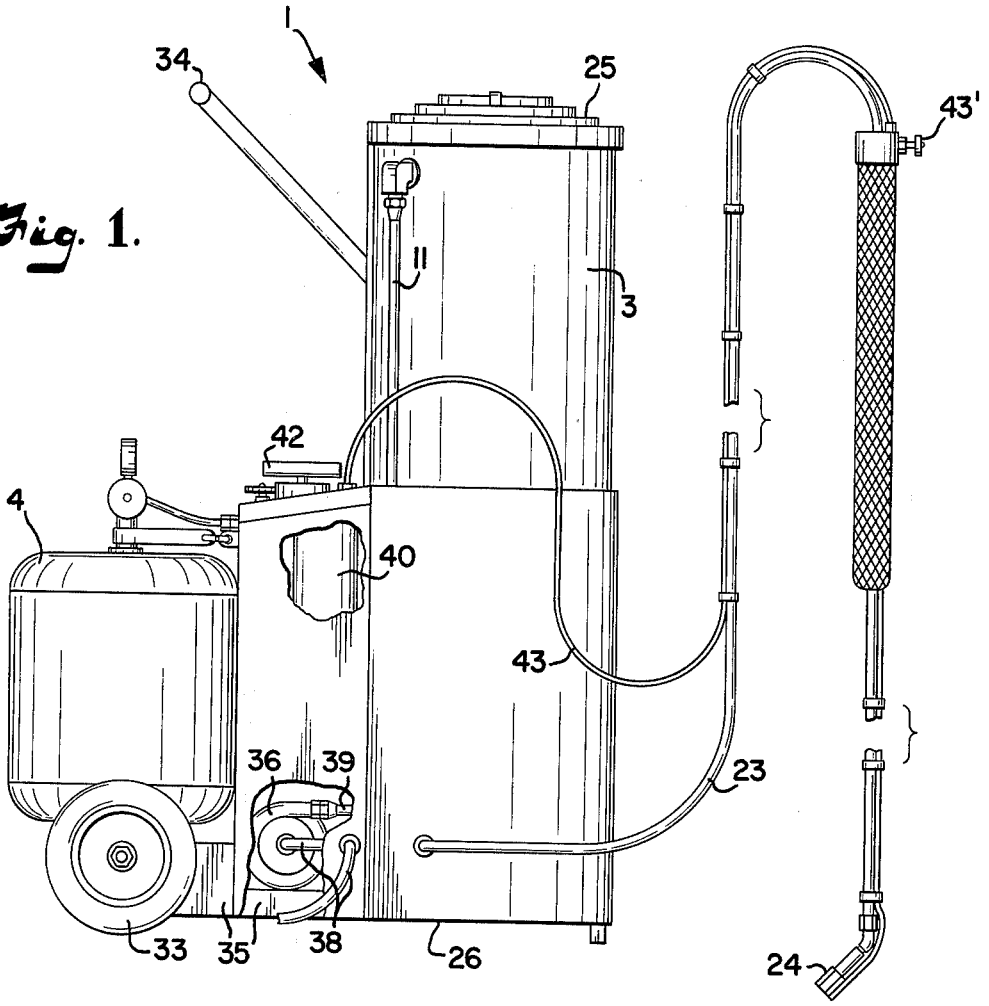
FIG. 1 is a side elevational view of a steam producing device embodying features of the present invention with portions broken away to show the component parts.
Figure 2:
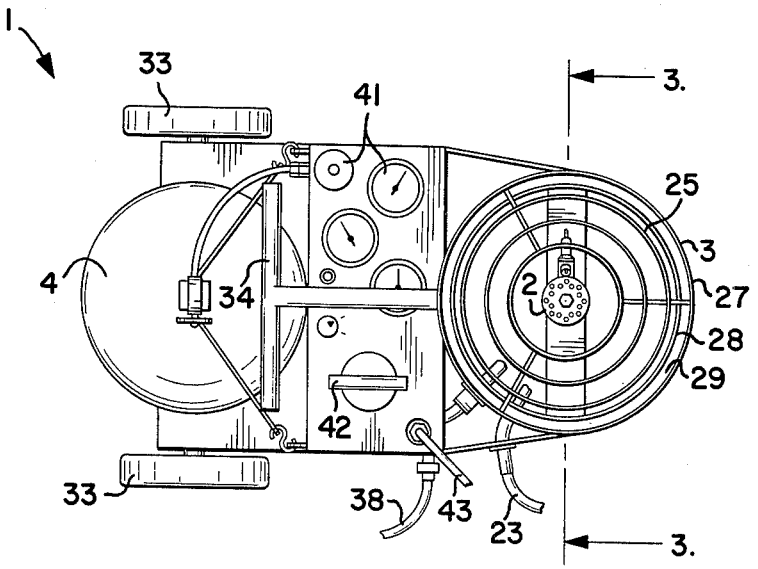
FIG. 2 is a top plan view of the steam producing device.
Figure 3:
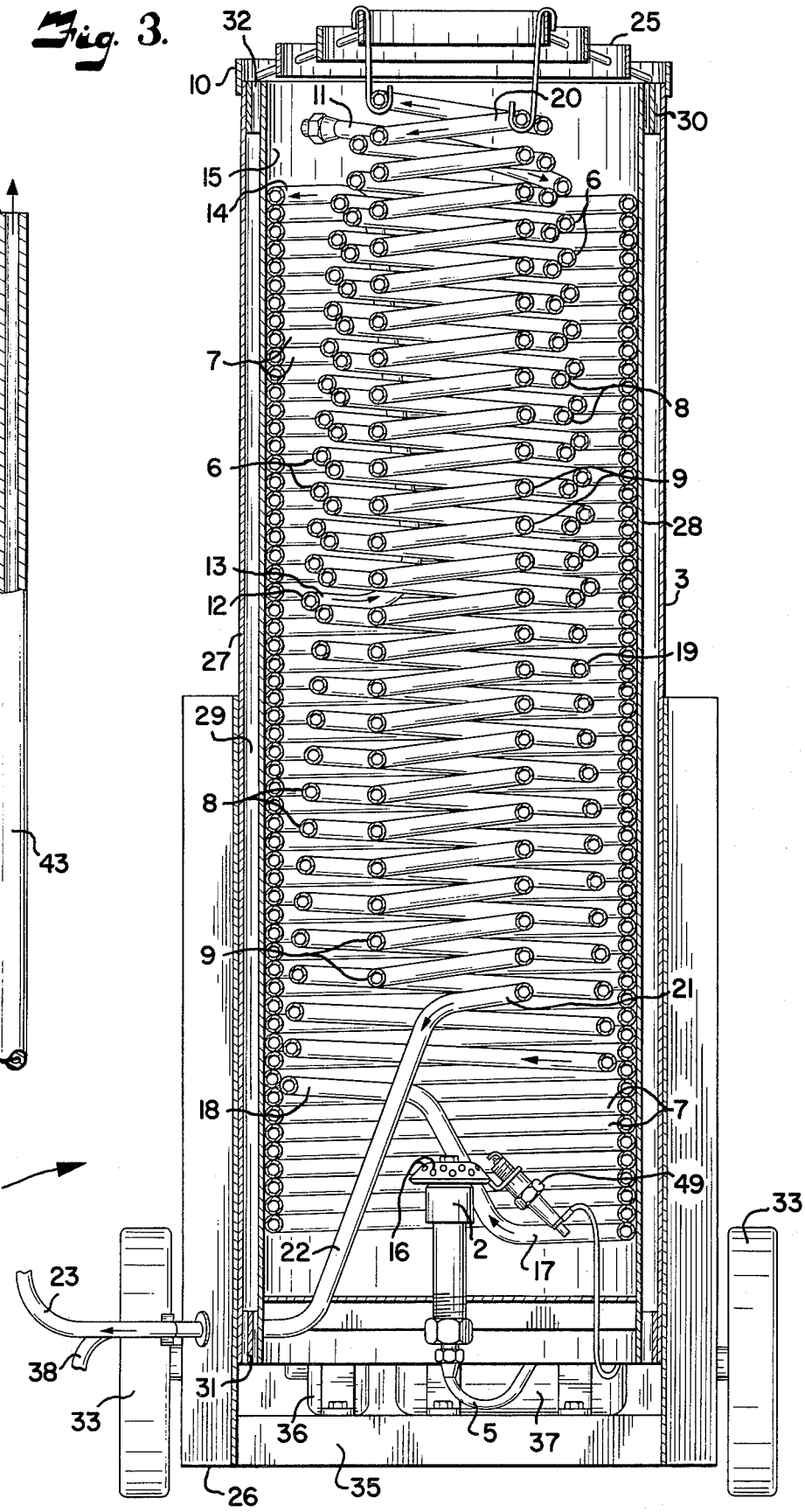
FIG. 3 is a vertical sectional view through the steam producing device, on a larger scale, taken on line 3—3, FIG. 2.
Figure 4:
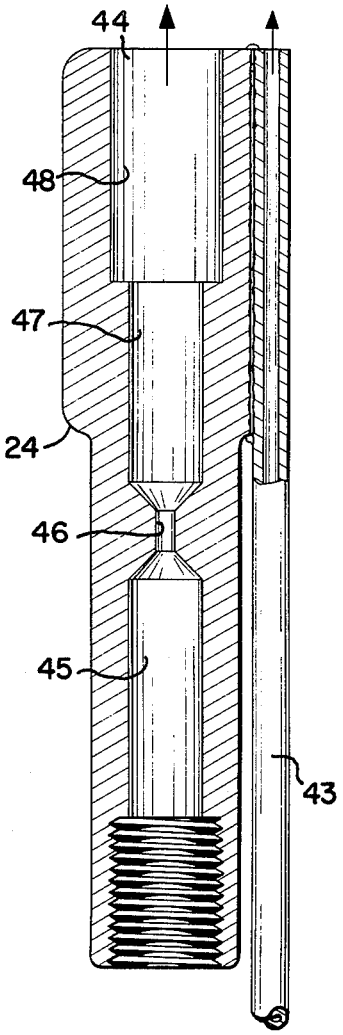
FIG. 4 is an enlarged, fragmentary, longitudinal sectional view through a nozzle of the steam producing device.

Referring more in detail to the drawings:

In the disclosed embodiment of the present invention, the reference numeral 1 generally designates a steam producing device which is operative to discharge high velocity steam for use in steam cleaning. The steam producing device 1 includes a burner 2 positioned within a housing 3. The burner 2 is fired by a suitable fuel, such as LP gas, contained within a tank 4 connected to the burner by means of a tube 5. The housing 3 contains a plurality of generally coaxial, fluid containing coils spaced around and above the burner 2 and including a warming coil 6, a closely wound wall cooling or intermediate coil 7, a preheat coil 8 and a final heat coil 9.

The warming coil 6 is located within the wall cooling or intermediate coil 7 and receives cold water near the top 10 of the housing 3 from a line 11, as described below. The warming coil 6 spirals conically outwardly and downwardly in spaced-apart turns to a position 12 near the vertical center of the housing 3 where it connects, through an upwardly directed leg 13, to the top 14 of the intermediate coil 7. The intermediate coil 7 spirals downwardly in preferrably contacting coils adjacent the inner surface 15 of the housing 3 to a lower elevation below the exit ports 16 of the burner 2 where it connects by a leg 17 to the bottom turn 18 of the preheat coil 8. The preheat coil 8 spirals conically inwardly and upwardly about the longitudinal center of the housing 3 forming a frustum of a cone 19 above the burner 2 with the turns spaced apart to permit the free flow of hot gasses therearound. The preheat coil 8 connects near the top 10 of the housing 3 with the uppermost turn 20 of the final heat coil 9 which spirals helically downwardly within the preheat coil 8 and terminates in a lower turn 21 spaced directly above the burner 2. The lower turn 21 communicates through a leg 22 with a flexible hose 23 which feeds a steam discharge nozzle 24 described further below.

The housing 3, in this example, comprises an upstanding, generally cylindrical, hollow structure having an open upper end 25, open lower end 26, outer wall 27, and coaxial inner wall 28 spaced inwardly from the outer wall 27 and providing an air space 29 therebetween. Corrugated spacers 30 and 31 maintain the inner and outer wall spacing and permit cooling air flow upwardly between the walls from the bottom 26 and out a circular mouth 32 at the upper end 25.

The illustrated device 1 is portable and includes suitable supporting wheels 33 which cooperate with a projecting handle 34 to permit easy movement to the site of use. The wheels 33 are journaled in a generally horizontally projecting platform 35 which supports the tank 4. The platform 35 also supports a motor driven pump 36, 37 which has a cold water input tube 38 and output line 39 communicating with the warming coil input line 11. The platform 35 further supports a cleansing liquid or detergent container 40 and suitable controls and indicators 41. The container 40 is pressurized by a hand pump 42 by which the cleansing liquid may be discharged through a line 43 which opens at the mouth 44 of the steam nozzle 24. A valve 43' permits control over cleasing liquid flow.

The nozzle 24 is structured for converting superheated water under pressure to high velocity steam. The hose 23 connects to a nozzle flow passageway 45 which reduces in diameter to a short throat 46 and then to a much larger expansion chamber 47, and still larger exit chamber 48 which opens at the mouth 44.

A spark plug 49 may be utilized to help insure a continuous flame from the burner 2 and suitable safety devices are integrated into the device to shut off fuel flow in case of low water pressure or excessive coil temperatures.

In operation, the pump 8 is activated to discharge water under pressure into the warming coil 6 and the burner 2 is energized to direct combustion heat at and about the intermediate coil 7, preheat coil 8 and final heat coil 9. The close turns of the intermediate coil 7 protect the inner wall 28 from the high heat and simultaneously provides an exposure surface to pick up peripheral heat for the water which would otherwise be wasted. Because the intermediate coil 7 receives slightly heated water from the warming coil 6, it does not promote sweating on the intermediate coil turns housing walls, which has been one difficulty with prior art devices.

The preheat coil 8 directs the heated water upwardly and conically inwardly from the intermediate coil 7, forming a tent-like arrangement over the burner flames and empties into the upper end of the final heat coil 9 which spirals downwardly directly over the hottest part of the burner flame, discharging into the hose 23. The flow path arrangement has been found to produce maximum heat transfer to the water without producing uncomfortably hot housing walls and without the need for thick, bulky insulation.

The pump system 36, 37 is operative to maintain a relatively high input pressure to the coils so that there is no tendency to reverse flow under pressure generated within the heated tubes. The nozzle throat 46 restricts output flow to the extent that, in cooperation with the pump system, sufficient pressure is maintained to inhibit the formation of steam therebetween, generally trapping superheated water in the coils. Once past the throat 46, the superheated water explodes into steam which is propelled at high velocity out the mouth 44. The specific size and pressure relationships needed to achieve this condition at a desired flow rate may be determined by those skilled in the art either by calculation or test. By way of example, utilizing a pump output pressure of about 250 psi, approximately 360 feet of ½ inch O.D. and ⅜ inch I.D. aluminum tubing arranged as shown (about 150 ft. in the intermediate coil 7), a heat input of up to about 165,000 B.T.U. per hour, a water flow rate of about 200–250 feet (approximately two gallons) per minute and a throat 46 of about 0.075 inch Dia. and approximately ⅛ inch in length, satisfactory results have been achieved. By raising the input pressure to about 600–700 psi, increasing the flow rate to 2½ to 3½ gallons per minute and increasing the heat input up to about 485,000 B.T.U. per hour, a higher operating capacity may be experienced.

Cleaning liquid may be discharged into the high velocity steam from the line 43 and need not be of the type which vaporizes at the temperatures involved.

It is to be understood that, while one form of this invention has been illustrated and described, it is not to be limited thereto except insofar as such limitations are included in the following claims.

What I claim and desire to secure by Letters Patent is:

1. A steam producing device comprising:

a. a hollow housing having a side wall with an inner surface;

b. a pump operative to discharge water under pressure;

c. a coil arrangement within said housing and receiving water under pressure from said pump and including an intermediate coil spiraling downwardly in turns adjacent said inner surface and each other;

d. said coil arrangement including a warming coil spaced inwardly from said inner surface and intermediate coil and upstream from said intermediate coil, said warming coil receiving the lowest temperature water in said coil arrangement;

e. a burner within said housing and positioned generally axially within said intermediate coil whereby said intermediate coil substantially protects said inner surface from direct burner heat, said warming coil being positioned to absorb heat from said burner and heat water therein prior to entry of the water into said intermediate coil, whereby said intermediate coil does not promote sweating on said said wall; and f. at least one additional coil downstream from said intermediate coil and connected to steam discharge means.

2. A steam producing device comprising:

a. a housing having a side wall with an inner surface and an open upper end and an open lower end;

b. a pump operative to discharge water under pressure;

c. a coil arrangement within said housing and receiving water under pressure from said pump and including a warming coil spaced inwardly of said inner surface and directing water downwardly, an intermediate coil having close turns adjacent said inner surface and directing water downwardly, a frusto conical preheat coil expanding downwardly and directing water upwardly and a final heat coil within said preheat coil and directing water downwardly;

d. a burner within said housing and directly below said final heat coil and a nozzle connected to said coil arrangement and having a flow restriction therein sufficient to maintain a substantial pressure upstream therefrom.

* * * * *